US011847961B2

(12) United States Patent
Lin

(10) Patent No.: US 11,847,961 B2
(45) **Date of Patent: *Dec. 19, 2023**

(54) ELECTRONIC DEVICE

(71) Applicant: Innolux Corporation, Miao-Li County (TW)

(72) Inventor: Chun-Hsien Lin, Miao-Li County (TW)

(73) Assignee: Innolux Corporation, Miaoli County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/994,378

(22) Filed: Nov. 27, 2022

(65) Prior Publication Data

US 2023/0101060 A1 Mar. 30, 2023

Related U.S. Application Data

(63) Continuation of application No. 17/308,016, filed on May 4, 2021, now Pat. No. 11,545,075.
(Continued)

(30) Foreign Application Priority Data

Dec. 15, 2020 (CN) ..... 202011476864.2

(51) Int. Cl.
*G09G 3/32* (2016.01)
*G09F 9/302* (2006.01)
*G09G 3/3225* (2016.01)

(52) U.S. Cl.
CPC ..... *G09G 3/32* (2013.01); *G09F 9/3026* (2013.01); *G09G 3/3225* (2013.01);
(Continued)

(58) Field of Classification Search
CPC ..... G09G 3/32; G09G 2330/021; G09G 2320/0626; G09G 2300/026; G09F 9/3026
(Continued)

(56) References Cited

U.S. PATENT DOCUMENTS 11,545,075 B2 * 1/2023 Lin ..... G09G 3/32
2004/0108977 A1 6/2004 Hirayama
(Continued)

OTHER PUBLICATIONS

"Office Action of Chinese Counterpart Application", dated Dec. 2, 2022, p. 1-p. 8.

*Primary Examiner* — Jason M Mandeville
(74) *Attorney, Agent, or Firm* — JCIPRNET

(57) ABSTRACT

An electronic device includes a substrate, an array circuit, a first distribution terminal, a second distribution terminal, a first power input terminal, a first wire and a second wire. The first distribution terminal and the second distribution terminal are disposed on a side surface of the substrate and are electrically connected to the array circuit. The first power input terminal, the first wire and the second wire are disposed on a bottom surface of the substrate. A first end of the first power input terminal is electrically connected to the first distribution terminals through the first wire. A second end of the first power input terminal opposite to the first end is electrically connected to the second distribution terminals through the second wire. A minimum distance between the first end and the first distribution terminal is less than a minimum distance between the second end and the first distribution terminal.

10 Claims, 7 Drawing Sheets

Related U.S. Application Data

(60) Provisional application No. 63/028,572, filed on May 22, 2020.

(52) U.S. Cl.
CPC ... *G09G 2300/026* (2013.01); *G09G 2300/04* (2013.01); *G09G 2300/0404* (2013.01); *G09G 2300/0426* (2013.01); *G09G 2320/0626* (2013.01); *G09G 2330/021* (2013.01)

(58) Field of Classification Search
USPC ..... 345/33
See application file for complete search history.

(56) References Cited

U.S. PATENT DOCUMENTS

| | | | | |
|---|---|---|---|---|
| 2007/0001711 | A1* | 1/2007 | Kwak | G09G 3/3233 324/762.07 |
| 2019/0392741 | A1* | 12/2019 | Cho | G09G 3/006 |
| 2020/0020272 | A1* | 1/2020 | Huang | G02F 1/13452 |
| 2020/0119126 | A1* | 4/2020 | Jo | H10K 59/1315 |
| 2021/0193687 | A1* | 6/2021 | Qi | H01L 27/1259 |
| 2021/0202906 | A1* | 7/2021 | Kim | H10K 59/10 |
| 2021/0217353 | A1* | 7/2021 | Zhao | H01L 27/0296 |
| 2021/0359180 | A1* | 11/2021 | Wu | G09G 3/006 |

* cited by examiner

ELECTRONIC DEVICE

CROSS-REFERENCE TO RELATED APPLICATION

This application is a continuation application of and claims the priority benefit of a prior application Ser. No. 17/308,016, filed on May 4, 2021. The prior application Ser. No. 17/308,016 claims the priority benefit of U.S. provisional application Ser. No. 63/028,572, filed on May 22, 2020, and China application serial no. 202011476864.2, filed on Dec. 15, 2020. The entirety of each of the above-mentioned patent applications is hereby incorporated by reference herein and made a part of this specification.

BACKGROUND

Technical Field

The disclosure relates to an electronic device, and more particularly to an electronic device capable of improving the problem of uneven brightness.

Description of Related Art

Electronic devices or splicing electronic devices have been widely used in mobile phones, televisions, monitors, tablet computers, car displays, wearable devices, and desktop computers. With the vigorous development of electronic devices, a demand for the high quality of electronic devices has risen. For example, uniform transmission of an electronic device to an active area (e.g., a display area) has become one of the research topics.

SUMMARY

According to an embodiment in the disclosure, a display panel includes a substrate, an array circuit, and a power supply circuit. The substrate includes a top surface, a bottom surface, and a side surface located between the top surface and the bottom surface. The array circuit is disposed on the top surface. Power is supplied to the array circuit through the power supply circuit. The power supply circuit includes a power input terminal corresponding to at least two distribution terminals. The at least two distribution terminals are disposed on the side surface and distribute the power to different portions of the array circuit.

According to an embodiment in the disclosure, a spliced display device includes a plurality of display panels, and each of the plurality of the display panels includes a substrate, an array circuit, and a power supply circuit. The substrate includes a top surface, a bottom surface, and a side surface located between the top surface and the bottom surface. The array circuit is disposed on the top surface. Power is supplied to the array circuit through the power supply circuit. The power supply circuit includes a power input terminal corresponding to at least two distribution terminals. The at least two distribution terminals are disposed on the side surface and distribute the power to different portions of the array circuit.

According to an embodiment in the disclosure, an electronic device includes a substrate, an array circuit, a first distribution terminal, a second distribution terminal, a first power input terminal, a first wire and a second wire. The substrate includes a top surface, a bottom surface, and a side surface located between the top surface and the bottom surface. The array circuit is disposed on the top surface. The first distribution terminal and the second distribution terminal are disposed on the side surface. The first distribution terminal and the second distribution terminal are electrically connected to the array circuit. The first power input terminal, the first wire and the second wire are disposed on the bottom surface. A first end of the first power input terminal is electrically connected to the first distribution terminals through the first wire. A second end of the first power input terminal is electrically connected to the second distribution terminals through the second wire. The first end of the first power input terminal is opposite to the second end of the first power input terminal. A first minimum distance between the first end of the first power input terminal and the first distribution terminal is less than a second minimum distance between the second end of the first power input terminal and the first distribution terminal.

BRIEF DESCRIPTION OF THE DRAWINGS

The accompanying drawings are included to further understand the disclosure, and the accompanying drawings are incorporated into this specification and constitute a part of this specification. The drawings illustrate the embodiments of the disclosure, and together with the description are used to explain the principles of the disclosure.

DESCRIPTION OF THE EMBODIMENTS

Figure 1A:
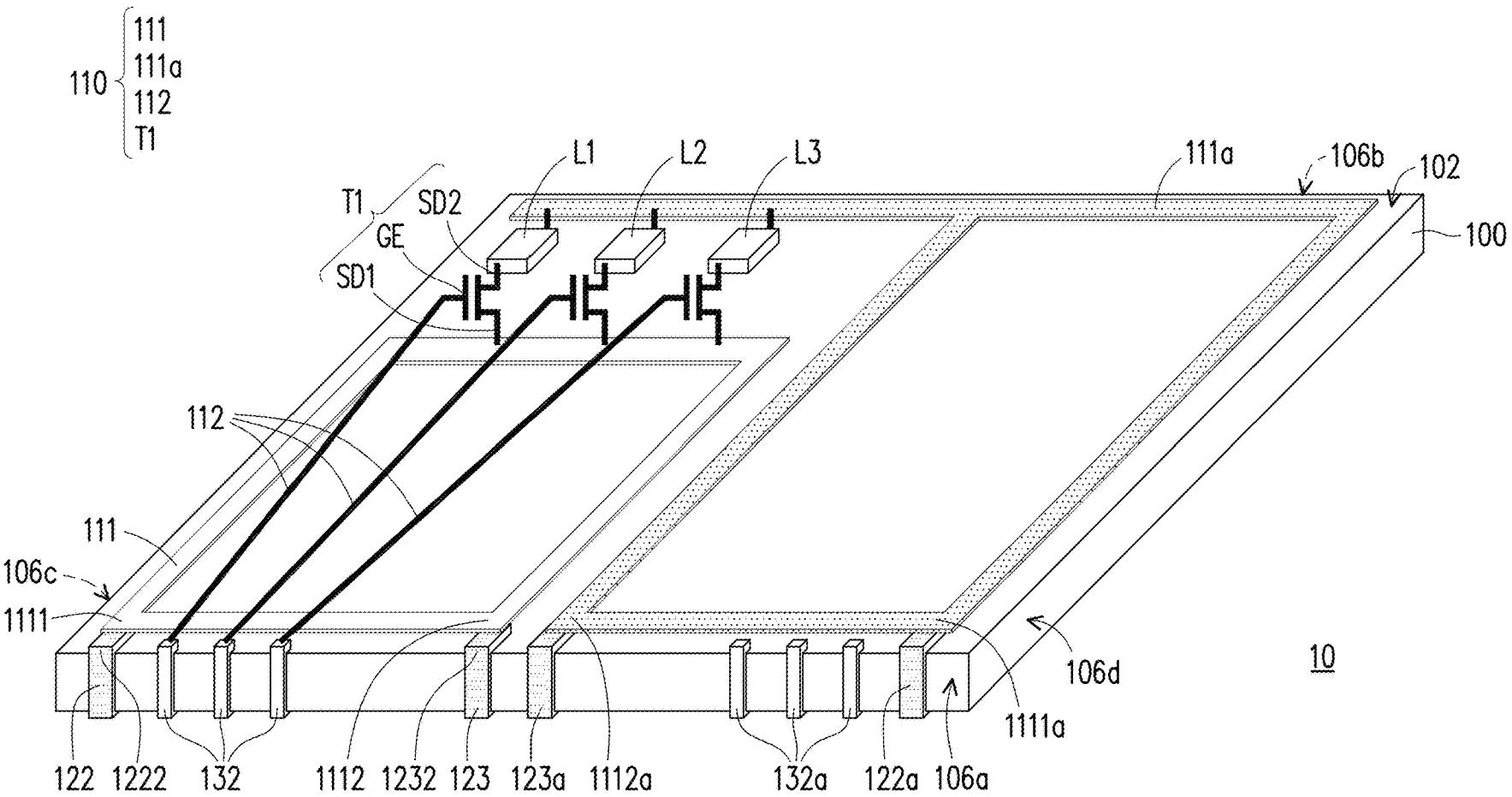
FIG. 1A is a schematic three-dimensional view of a top surface of a display panel according to an embodiment of the disclosure.

The disclosure can be understood by referring to the following detailed description in conjunction with the accompanying drawings. It is noted that for comprehension of the reader and simplicity of the drawings, in the drawings of the disclosure, only a part of the electronic device is shown, and specific elements in the drawings are not necessarily drawn to scale. Moreover, the quantity and the size of each element in the drawings are only schematic and are not intended to limit the scope of the disclosure.

In the following specification and claims, the terms "including" and "having", etc., are open-ended terms, so they should be interpreted to mean "including but not limited to . . . ".

Throughout the specification and the appended claims of the disclosure, certain terms are used to refer to specific elements. Those skilled in the art should understand that electronic device manufacturers may probably use different names to refer to the same elements. This specification is not intended to distinguish between elements that have the same function but different names. When the terms "include", "comprise" and/or "have" are used in this specification, they specify the existence of the described features, regions, steps, operations, and/or elements, but they do not exclude the existence or the addition of one or more other features, regions, steps, operations, elements, and/or combinations thereof.

When an element, a layer, or a region is referred to as being "on" or "extending to" another element (or a variant thereof), it can be directly set on said other element or directly extending to said other element, or there is an intervening element between the two. In contrast, when an element is referred to as being "directly on" or "directly extending to" another element (or a variant thereof), there is no intervening element between the two. Also, when an element is referred to as being "coupled" to another element (or a variant thereof), it can be directly connected to another element or indirectly connected (e.g., electrically connected) to another element through one or more elements.

The terms such as "substantially" or "approximately" are generally interpreted as being within a range of plus or minus 10% of a given value or range, or as being within a range of plus or minus 5%, plus or minus 3%, plus or minus 2%, plus or minus 1%, or plus or minus 0.5% of the given value or range. The quantity given here is an approximate quantity, that is, the meaning of "approximately" and "substantially" can still be implied without a specific description of "approximately" or "substantially". In addition, the term "a given range is between the first value and the second value" means the given range includes the first value, the second value, and values between the two values.

It can be understood that the terms such as "first", "second", and the like in this specification may be used for describing various elements, layers, and/or parts, but the elements, layers, and/or parts are not limited by such terms. The terms are only used to distinguish one element, layer, or part from another element, layer, or part. Therefore, a "first element", "first layer", or "first part" discussed below is used to being referred to a "second element", "second layer", or "second part" without departing the teaching of the embodiments in the disclosure. In addition, for the conciseness, the terms such as "first" and "second" may not be used in the specification to distinguish different elements. Without violating the scope defined by the appended claims, the first element and/or the second element described in the claims can be interpreted as any elements that meet the description in the specification.

In the disclosure, the thickness, length, or width may be measured by an optical microscope, and the thickness may be measured according to a cross-sectional image in an electron microscope, but the disclosure is not limited thereto. In addition, there may be a certain error between any two values or directions used for comparison. If a first value is equal to a second value, it is implied that there may be an error of about 10% between the first value and the second value; if a first direction is perpendicular to a second direction, the angle between the first direction and the second direction may be 80 degrees to 100 degrees; and if the first direction is parallel to the second direction, the angle between the first direction and the second direction may be 0 degrees to 10 degrees.

Unless otherwise defined, all terms (including technical and scientific terms) used in the specification have the same meanings commonly understood by those skilled in the art. It is understandable that the terms, such as terms defined in commonly used dictionaries, should be interpreted as having a meaning consistent with that in the related art, in the background, or in the context of the disclosure, and they should not be interpreted in an idealized or overly formal way, unless specifically defined.

It should be noted that the technical features of multiple embodiments to be described below may be replaced, recombined, or mixed to form other embodiments without departing from the spirit of the disclosure.

In the disclosure, the length and width can be measured by using an optical microscope, and the thickness can be measured based on a cross-sectional image in an electron microscope, but not limited to this. In addition, any two values or directions used for comparison may have certain errors.

The electronic device in the disclosure may include a display device, an antenna device (e.g., an LCD antenna), a sensing device, a light-emitting device, a touch display device, a curved display device, or a free shape display device, a bendable or flexible electronic device, a spliced device, or a combination thereof, but the disclosure is not limited thereto. The electronic device may include light-emitting diodes (LEDs), liquid crystals, fluorescence, phosphor, or quantum dots (QDs), other suitable materials, or a combination thereof, but the disclosure is not limited thereto. The light-emitting diodes may include organic light-emitting diodes (OLEDs), inorganic light-emitting diodes, mini LEDs, micro LEDs or quantum dot light-emitting diodes (QLEDs, QDLEDs), other suitable types of LED, or a combination thereof, but the disclosure is not limited thereto. It is noted that the electronic device may be a combination thereof, but the disclosure is not limited thereto. The electronic device may have peripheral systems such as a driving system, a control system, a light source system, a shelf system, etc. The content of the disclosure is described by using a display device, but the disclosure is not limited thereto.

In the disclosure, the features of multiple embodiments to be described below may be replaced, recombined, or mixed to form other embodiments without departing from the spirit of the disclosure. The features of multiple embodiments may be used in combination, as long as such combination does not depart from the spirit of the disclosure or lead to conflict.

Reference will now be made in detail to the exemplary embodiments of the disclosure, examples of which are illustrated in the accompanying drawings. Whenever possible, the same reference numerals are used to represent the same or similar parts in the accompanying drawings and description.

Figure 1B:
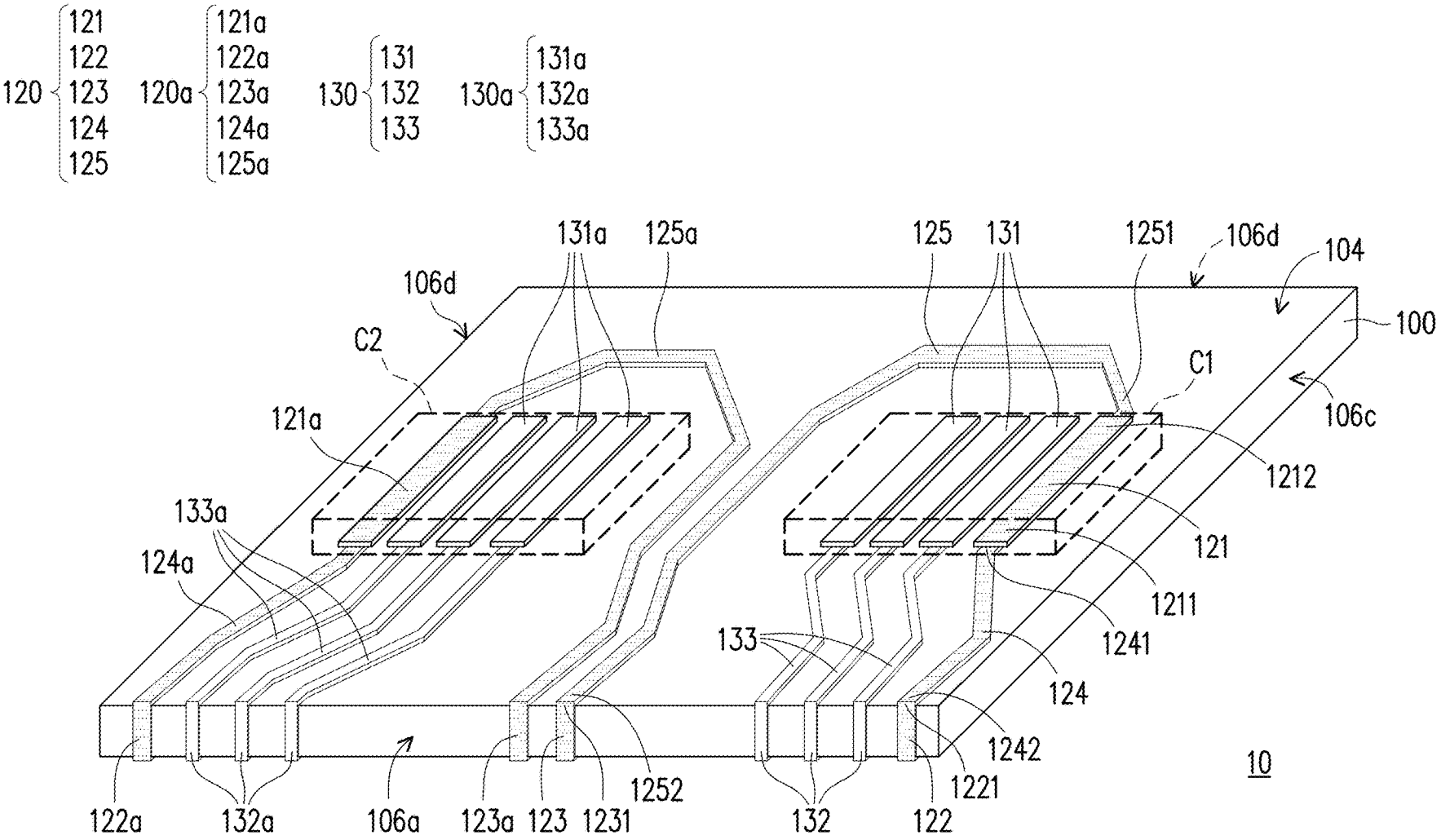
FIG. 1B is a schematic three-dimensional view of a bottom surface of the display panel of FIG. 1A.

FIG. 1A is a schematic three-dimensional view of a top surface of a display panel according to an embodiment of the disclosure. FIG. 1B is a schematic three-dimensional view of a bottom surface of the display panel of FIG. 1A.

Referring to both FIG. 1A and FIG. 1B, a display panel 10 in the embodiment includes a substrate 100, an array circuit 110, power supply circuits 120 and 120*a*, and a plurality of light-emitting elements (e.g., light-emitting elements L1, L2, and L3). FIG. 1A schematically shows three light-emitting elements, but the disclosure is not limited thereto. The substrate 100 has a top surface 102, a bottom surface 104, and side surfaces (e.g., side surfaces 106*a*, 106*b*, 106*c*, and 106*d*) located between the top surface 102 and the bottom surface 104. FIG. 1A schematically shows 4 side surfaces, but the disclosure is not limited thereto. The side surfaces (e.g., the side surfaces 106*a*, 106*b*, 106*c*, and 106*d*) are connected between the top surface 102 and the bottom surface 104, for example. For example, the side surface 106*a* is opposite to the side surface 106*b*, and the side surface 106*c* is opposite to the side surface 106*d*. In some embodiments, the substrate 100 may include a rigid substrate, a flexible substrate, or a combination thereof. The material of the substrate 100 may include glass, quartz, sapphire, ceramics, polycarbonate (PC), polyimide (PI), polyethylene terephthalate (PET), other suitable substrate materials, or a combination thereof, but the disclosure is not limited thereto.

Referring to FIG. 1A, the array circuit 110 is disposed on the top surface 102 of the substrate 100 to be electrically connected to the power supply circuit (e.g., the power supply circuit 120 and the power supply circuit 120*a*) and the light-emitting elements (e.g., the light-emitting elements L1, L2, and L3). In some embodiments, the array circuit 110 may include a power line 111, a power line 111*a*, a signal line 112 (e.g., a scan line or a data line, but the disclosure is not limited thereto), a transistor T1 and/or a capacitor (not shown), but the disclosure is not limited thereto. In some embodiments, the transistor T1 may include a gate GE, a source SD1, and a drain SD2, but the disclosure is not limited thereto. In other embodiments, the positions of the source SD1 and the drain SD2 may be exchanged. In some embodiments, the power line 111 may be electrically connected to a plurality of transistors T1 (e.g., the source SD1 of the transistor T1, but the disclosure is not limited thereto). In some embodiments, different signal lines 112 respectively may be electrically connected to the corresponding transistor T1 (e.g., the gate GE of the transistor T1), and different transistors T1 (e.g., the drain SD2 of the transistor T1) respectively may be electrically connected to the corresponding light-emitting elements (e.g., the light-emitting elements L1, L2, and L3), but the disclosure is not limited thereto. In some embodiments, the power line 111*a* may be electrically connected to another terminal of the light-emitting elements (e.g., the light-emitting elements L1, L2, and L3), but the disclosure is not limited thereto. In some embodiments, the power line 111 and the power line 111*a* respectively transmit different signals, for example. For example, the power line 111 may be adapted to transmit a first signal (e.g., VDD), and the power line 111*a* may be adapted to transmit a second signal (e.g., Vss), but the disclosure is not limited thereto. In some embodiments (refer to FIG. 1A and FIG. 1B), the power supply circuit 120 and/or the power supply circuit 120*a* may be electrically connected to a plurality of light-emitting elements (e.g., the light-emitting elements L1, L2, and L3) through the array circuit 110. In this way, the power from the power supply circuits 120 and 120*a* is transmitted to a plurality of light-emitting elements (e.g., the light-emitting elements L1, L2, and L3) to drive the light-emitting elements to emit light. Note that the connection relationship or the size (or appearance) of the elements of the array circuit 110 are only exemplary, and other connection relationships or the size (or appearance) of the elements may be designed according to requirements. For example, the appearance of the power supply line 111 and the power supply line 111*a* is only exemplary.

Referring to both FIG. 1A and FIG. 1B, the power supply circuit 120 may be disposed on the bottom surface 104 and the side surface 106*a* of the substrate 100. The material of the circuits in the power supply circuit 120 may include transparent conductive materials or non-transparent conductive materials, such as indium tin oxide, indium zinc oxide, indium oxide, zinc oxide, tin oxide, and metal materials (e.g., aluminum, molybdenum, copper, and silver, etc.), other suitable materials, or a combination thereof, but the disclosure is not limited thereto. In some embodiments, the power supply circuit 120 may have a power input terminal 121 and at least two distribution terminals (e.g., a distribution terminal 122 and a distribution terminal 123), the power input terminal 121 corresponds to the at least two distribution terminals (e.g., distribution terminal 122 and distribution terminal 123), and the power input terminal 121 is disposed on the bottom surface 104 of the substrate 100. In some embodiments, the power supply circuit 120 may have a first wire 124 and a second wire 125, but the disclosure is not limited thereto. In some embodiments, the power supply circuit 120*a* may have a power input terminal 121*a*, at least two distribution terminals (e.g., a distribution terminal 122*a* and a distribution terminal 123*a*), a first wire 124*a*, and a second wire 125*a*, but the disclosure is not limited thereto. The power input terminal 121*a* corresponds to the at least two distribution terminals (e.g., the distribution terminal 122*a* and the distribution terminal 123*a*). In some embodiments, the power input terminal 121 (or the power input terminal 121*a*), the first wire 124 (or the first wire 124*a*), and the second wire 125 (or the second wire 125*a*) may be respectively disposed on the bottom surface 104 of the substrate 100, and the first wire 124 (or the first wire 124*a*) and the second wire 125 (or the second wire 125*a*) may be formed by a same film layer. In some embodiments, the at least two distribution terminals (e.g., the distribution terminal 122 and the distribution terminal 123, or the distribution terminal 122*a* and the distribution terminal 123*a*) may be respectively disposed on (or scattered on) the side surface (e.g., the side surface 106*a*) of the substrate 100.

In some embodiments, the power input terminal 121 may have a first end 1211 and a second end 1212 opposite to each other; the first wire 124 has a third end 1241 and a fourth end 1242 opposite to each other; and the second wire 125 has a third end 1251 and a fourth end 1252 opposite to each other. At least two distribution terminals (e.g., the distribution terminals 122 and the distribution terminals 123) may be scattered on the side surface 106*a* of the substrate 100; the distribution terminal 122 has a fifth end 1221 and a sixth end 1222 opposite to each other; and the distribution terminal 123 has a fifth end 1231 and a sixth end 1232 opposite to each other. In some embodiments, the first end 1211 of the power input terminal 121 may be electrically connected to the third end 1241 of the first wire 124, and the second end 1212 of the power input terminal 121 may be electrically connected to the third end 1251 of the second wire 125. The fourth end 1242 of the first wire 124 may be electrically connected to the fifth end 1221 of the distribution terminal 122, and the fourth end 1252 of the second wire 125 may be electrically connected to the fifth end 1231 of the distribution terminal 123, but the disclosure is not limited thereto. In some embodiments, the sixth end 1222 of the distribution terminal 122 may be electrically connected to a first portion 1111 of the power line 111 of the array circuit 110, and the sixth end 1232 of the distribution terminal 123 may be electrically connected to a second portion 1112 of the power line 111 of the array circuit 110. That is, the third end 1241 and the fourth end 1242 of the first wire 124 may be electrically connected to the power input terminal 121 and the distribution terminal 122, respectively; and the third end 1251 and the fourth end 1252 of the second wire 125 may be electrically connected to the power input terminal 121 and the distribution terminal 123, respectively. The fifth end 1221 and the sixth end 1222 of the distribution terminal 122 may be electrically connected to the first wire 124 and the first portion 1111 of the power line 111 of the array circuit 110, respectively; and the fifth end 1231 and the sixth end 1232 of the distribution terminal 123 may be electrically connected to the second wire 125 and the second portion 1112 of the power line 111 of the array circuit 110, respectively. That is, at least two distribution terminals (e.g., the distribution terminals 122 and the distribution terminals 123) may be electrically connected to different portions (i.e., the first portion 1111 and the second portion 1112 of the power line 111) of the power line 111 of the array circuit 110. In some embodiments, at least two distribution terminals may distribute the power to different portions (i.e., the first portion 1111 and the second portion 1112 of the power line 111) of the array circuit 110. In some embodiments, the power input terminal 121 may correspond to or may be electrically connected to at least two distribution terminals (e.g., the distribution terminal 122 and the distribution terminal 123), for example; and the power input terminal 121 may be electrically connected to two (e.g., the distribution terminal 122 and the distribution terminal 123) of the at least two distribution terminals through the first wire 124 and the second wire 125, respectively, and may be electrically connected to different portions (i.e., the first portion 1111 and the second portion 1112) of the power line 111 and/or the light-emitting elements (the light-emitting elements L1, L2, and L3) through the distribution terminals; but the disclosure is not limited thereto. In some embodiments, the first portion 1111 and the second portion 1112 may be electrically connected to each other. In some embodiments, the first portion 1111 and the second portion 1112 may be formed by a same conductive layer.

In some embodiments, a first minimum distance between the first end 1211 of the power input terminal 121 and the distribution terminal 122 is less than a second minimum distance between the second end 1212 of the power input terminal 121 and the distribution terminal 122.

In some embodiments, the first wire 124*a* is connected to a first end of the power input terminal 121*a*, the second wire 125*a* is connected to a second end of the power input terminal 121*a*, the first end of the power input terminal 121*a* is opposite to the second end of the power input terminal 121*a*, and the first end of the power input terminal 121*a* is closer to the side surface 106*a* than the second end of the power input terminal 121*a*.

In some embodiments, the second wire 125 (or the second wire 125*a*) includes a first segment, a second segment, a third segment and a fourth segment, and an extension direction of the first segment, an extension direction of the second segment, an extension direction of the third segment and an extension direction of the fourth segment are different. In some embodiments, the power input terminal 121 is disposed between an edge of the substrate 100 and the fourth segment of the second wire 125 (or the second wire 125*a*).

In some embodiments, for example, the power supply circuit (e.g., the power supply circuit 120 or the power supply circuit 120*a*) may receive the current provided by an electronic element (e.g., an electronic element C1 or an electronic element C2), and the power is supplied to the array circuit 110 through a power supply circuit (e.g., the power supply circuit 120 or the power supply circuit 120*a*). The electronic element C1 or the electronic element C2 may include a chip or a flexible printed circuit (FPC) board, but the disclosure is not limited thereto. Specifically, in some embodiments, the power input terminal (e.g., the power input terminal 121 or the power input terminal 121*a*) in the power supply circuit (e.g., the power supply circuit 120 or the power supply circuit 120*a*) distributes the power input or provided by the corresponding electronic element (e.g., the electronic element C1 or the electronic element C2) to the first wire (e.g., the first wire 124 or the first wire 124*a*) and the second wire (e.g., the second wire 125 or the second wire 125*a*). Then, the first wire (e.g., the first wire 124 or the first wire 124*a*) and the second wire (e.g., the second wire 125 or the second wire 125*a*) respectively transmit the power to the corresponding at least two distribution terminals, such as the distribution terminal 122 (or the distribution terminal 122*a*) and the distribution terminal 123 (or the distribution terminal 123*a*). Then, through at least two distribution terminals, the power is distributed to different portions of the array circuit 110, such as the first portion (e.g., the first portion 1111 or the first portion 1111*a*) and the second portion (e.g., the second portion 1112 or the second portion 1112*a*) of the array circuit 110. For example, the power input terminal (e.g., the power input terminal 121 or the power input terminal 121*a*) may respectively correspond to two distribution terminals so that for example, the two distribution terminals may distribute the power in an approximate ratio of 1:1 to the different portions of the array circuit 110 of the array circuit 110, such as the first portion (the first portion 1111 or the first portion 1111*a*) and the second portion (the second portion 1112 or the second portion 1112*a*), but the disclosure is not limited thereto. In other words, one distribution terminal (e.g., the distribution terminal 122 or the distribution terminal 122*a*) transmits approximate ½ of the power (or current) to the first portion (e.g., the first portion 1111 or the first portion 1111*a*) of the array circuit 110, and another distribution terminal (e.g., the distribution terminal 123 or the distribution terminal 123*a*) transmits approximate ½ of the power (or current) to the second portion (e.g., the second portion 1112 or the second portion 1112*a*) of the array circuit 110.

In some embodiments, for example, the distribution terminal 122 is adjacent to the side surface 106*c* of the substrate 100, the distribution terminal 123 is away from the side surface 106*c* of the substrate 100, and there are other terminals (e.g., a transmission terminal 132) between the distribution terminal 122 and the distribution terminal 123, so that the distribution terminal 122 and the distribution terminal 123 may be scattered on different portions of the side surface 106*a* of the substrate 100, but the disclosure is not limited thereto. In some embodiments, for example, the distribution terminal 122*a* is adjacent to the side surface 106*d* of the substrate 100, the distribution terminal 123*a* is away from the side surface 106*d* of the substrate 100, and there are other wires (e.g., a transmission terminal 132*a*) between the distribution terminal 122*a* and the distribution terminal 123*a*, so that the distribution terminal 122 and the distribution terminal 123 may be scattered on different portions of the side surface 106*a* of the substrate 100, but the disclosure is not limited thereto. As described above, since one distribution terminal (e.g., the distribution terminal 122 or the distribution terminal 122*a*) and another distribution terminal (e.g., the distribution terminal 123 or the distribution terminal 123*a*) may be scattered on different portions of the side surface 106*a* of the substrate 100, the power (or current) transmitted or provided by the power supply circuit (e.g., the power supply circuit 120 or the power supply circuit 120*a*) may respectively be uniformly distributed to the first portion (e.g., the first portion 1111 or the first portion 1111*a*) and the second portion (e.g., the second portion 1112 or the second portion 1112*a*) of the array circuit 110 through at least two electrically connected or corresponding distribution terminals, the power (or current) may be uniformly distributed in the array circuit 110, and the power is more uniformly transmitted to different light-emitting elements (e.g., the light-emitting elements L1, L2, and L3) so that the uniformity of brightness of the light emitted by the light-emitting elements is improved. Therefore, in the existing electronic devices, the power may only be transmitted through a single circuit path, so the problem of voltage drop (IR drop) is prone to occur, causing the problem of uneven brightness of the light-emitting element. In contrast, in the electronic device in the embodiment, power (or current) is transmitted through at least two circuit paths, thereby improving the problems of voltage drop or uneven brightness of light-emitting elements.

Referring to both FIG. 1A and FIG. 1B, in some embodiments, the power supply circuit 120 and the power supply circuit 120*a* are disposed on the bottom surface 104 and adjacent to each other. In some embodiments, for example, the power input terminal 121 of the power supply circuit 120 is away from the power supply circuit 120*a*, and for example, the power input terminal 121*a* of the power supply circuit 120*a* is away from the power supply circuit 120, but the disclosure is not limited thereto. In some embodiments, the power input terminal 121, the first wire 124, and the distribution terminal 122 of the power supply circuit 120 are adjacent to the side surface 106*c* of the substrate 100. In some embodiments, the distribution terminal 123 of the power supply circuit 120 is away from the side surface 106*c* of the substrate 100. In some embodiments, the power input terminal 121*a*, the first wire 124*a*, and the distribution terminal 122*a* of the power supply circuit 120*a* are adjacent to the side surface 106*d* of the substrate 100. In some embodiments, the distribution terminal 123*a* of the power supply circuit 120*a* is away from the side surface 106*d* of the substrate 100.

Referring to FIG. 1B again, the display panel 10 in the embodiment further includes a signal supply circuit (e.g., a signal supply circuit 130 or a signal supply circuit 130*a*) disposed on the bottom surface 104 of the substrate 100. For example, the signal supply circuit (e.g., the signal supply circuit 130 or the signal supply circuit 130*a*) may receive a signal (e.g., a scan signal or a data signal, but the disclosure is not limited thereto) provided by an electronic element (e.g., the electronic element C1 or the electronic element C2) and provide the array circuit 110 with the signal through the signal supply circuit (e.g., the signal supply circuit 130 or the signal supply circuit 130*a*). The signal supply circuit (e.g., the signal supply circuit 130 or the signal supply circuit 130*a*) may have at least one signal input terminal (e.g., a signal input terminal 131 or a signal input terminal 131*a*), at least one transmission terminal (e.g., the transmission terminal 132 or the transmission terminal 132*a*), and at least one third wire (e.g., a third wire 133 or a third wire 133*a*); and the signal input terminal (e.g., the signal input terminal 131 or the signal input terminal 131*a*) corresponds to the transmission terminal (e.g., the transmission terminal 132 or the transmission terminal 132*a*); but the disclosure is not limited thereto. In some embodiments, the signal input terminal (e.g., the signal input terminal 131 or the signal input terminal 131*a*) may be electrically connected to the transmission terminal (e.g., the transmission terminal 132 or the transmission terminal 132*a*) through the third wire (e.g., the third wire 133 or the third wire 133*a*).

Since the elements of the signal supply circuit 130 and the signal supply circuit 130*a* are similar, the signal supply circuit 130 is illustrated as an example for description below. In some embodiments, the signal input terminal 131 and the third wire 133 of the signal supply circuit 130 may be respectively disposed on the bottom surface 104 of the substrate 100, and the transmission terminal 132 may be disposed on the side surface 106*a* of the substrate 100. In some embodiments, for example, the transmission terminal (e.g., the transmission terminal 132 or the transmission terminal 132*a*) is disposed on the side surface (e.g., the side surface 106*b*) and located between two of the at least two distribution terminals. For example, at least one transmission terminal 132 may be located between the distribution terminal 122 and the distribution terminal 123, and at least one transmission terminal 132' may be located between the distribution terminal 122' and the distribution terminal 123'. In some embodiments, the transmission terminal (e.g., the transmission terminal 132 or the transmission terminal 132*a*) may transmit a signal to the array circuit 110. In some embodiments, at least one third wire 133 may be disposed between the first wire 124 and the second wire 125 of the power supply circuit 120. In some embodiments, the first wire 124, the second wire 125, and/or the third wire 133 may be formed by a same film layer (e.g., a conductive layer), but the disclosure is not limited thereto. Referring to both FIG. 1A and FIG. 1B, in some embodiments, signals may be transmitted to the corresponding or electrically connected third wire 133 through the signal supply circuit 130, the signals are further transmitted to the corresponding or electrically connected transmission terminal 132 to transmit the signals respectively to a signal line 112 of the array circuit 110, and the signal line 112 is adapted to drive the respectively electrically connected light-emitting elements (e.g., the light-emitting element L1, L2, and L3), but the disclosure is not limited thereto. In some embodiments, from a perspective in the normal direction of the bottom surface 104 of the substrate 100, the power input terminal (e.g., power input terminal 121 or power input terminal 121*a*), the first wire (e.g., first wire 124 or first wire 124*a*), and the second wire (e.g., second wire 125 or second wire 125*a*) are connected to one another and surround the signal input terminal (e.g., the signal input terminal 131 or the signal input terminal 131*a*) and the third wire (e.g., the third wire 133 or the third wire 133*a*).

In some embodiments (as shown in FIG. 1B), at least one electronic element (e.g., the electronic element C1 or the electronic element C2) may be disposed on the bottom surface 104 of the substrate 100, and the electronic element (e.g., the electronic element C1 or the electronic element C2) may be electrically connected to or bonded with the signal input terminal (e.g., the signal input terminal 131 or the signal input terminal 131*a*) and the power input terminal (e.g., the power input terminal 121 or the power input terminal 121*a*). In some embodiments, at least one electronic element (e.g., the electronic element C1 or the electronic element C2) may have multiple bonding pads (not shown); the bonding pads may respectively correspond to the signal input terminal and/or the power input terminal; and the bonding pads, for example, are electrically connected to or bonded with the corresponding signal input terminal and/or the power input terminal.

In some embodiments, the power input terminal (e.g., the power input terminal 121 or the power input terminal 121*a*) in the disclosure may correspond to or may be electrically connected to two distribution terminals, but the disclosure does not limit the number of distribution terminals corresponding to the power input terminal. In some embodiments, the power input terminal may correspond to at least two or more distribution terminals so that the at least two or more distribution terminals distribute power to different portions of the array circuit.

Although all the distribution terminals in the embodiment are disposed on the same side surface (e.g., the side surface 106*a*), the disclosure does not limit the location of the distribution terminals. In some embodiments, different distribution terminals corresponding to or electrically connected to the same power input terminal may be respectively disposed on the same or different side surfaces. For example (not shown), different distribution terminals (e.g., the distribution terminal 122 and the distribution terminal 123) corresponding to the power input terminal 121 may be respectively disposed on the same or different side surfaces (including the side surface 106*a*, the side surface 106*b*, the side surface 106*c*, and/or the side surface 106*d*), or different distribution terminals (e.g., the distribution terminal 122*a* and the distribution terminal 123*a*) corresponding to the power input terminal 121*a* may be respectively disposed on the same or different side surfaces (including the side surface 106*a*, the side surface 106*b*, the side surface 106*c*, and/or the side surface 106*d*).

Although in the embodiment, the distribution terminal 122 and the distribution terminal 123 corresponding to or electrically connected to the power input terminal 121 respectively transmit approximate ½ of the power (or current) to the first portion 1111 and the second portion 1112 of the array circuit 110, and the distribution terminal 122*a* and the distribution terminal 123*a* corresponding to or electrically connected to the power input terminal 121*a* respectively transmit approximate ½ of the power (or current) to the first portion 1111*a* and the second portion 1112*a* of the array circuit 110, the disclosure does not limit the ratio of power (or current) transmitted by the distribution terminals. For example, when the power input terminal 121 corresponds to two distribution terminals (e.g., the distribution terminal 122 and the distribution terminal 123), the two distribution terminals distribute power to different portions of the array circuit 110 (e.g., the first portion 1111 and the second portion 1112) in an approximate ratio of 1:1.

Specifically, since the voltages transmitted by the distribution terminals are the same as the voltages provided by the corresponding or electrically connected power input terminal, the current and/or power distributed or transmitted by the distribution terminals may be roughly divided according to the number of distribution terminals electrically connected to the power input terminal. For example, when the number of the distribution terminals electrically connected to the power input terminal is n, the ratio of current (and/or power) distributed to the distribution terminals is approximately 1/n.

Although three signal input terminals 131 (or input terminals 131*a*), three transmission terminals 132 (or transmission terminals 132*a*), and three third wires 133 (or third wires 133*a*) are shown respectively, the disclosure does not limit the number of the signal input terminals, the transmission terminals, and the third wires.

In addition, the display panel 10 in the embodiment may also be spliced into a spliced display device (not shown). That is, the spliced display device in the embodiment may include multiple display panels 10.

Other embodiments are provided below for explanation. It should be noted here that the following embodiments adopt the reference numbers and partial contents of the foregoing embodiments, wherein the same reference numbers are used to indicate the same or similar elements, and the description of the same technical content is omitted. For the description of the omitted parts, reference may be made to the foregoing embodiments, and the same content will not be iterated in the following embodiments.

Figure 2A:
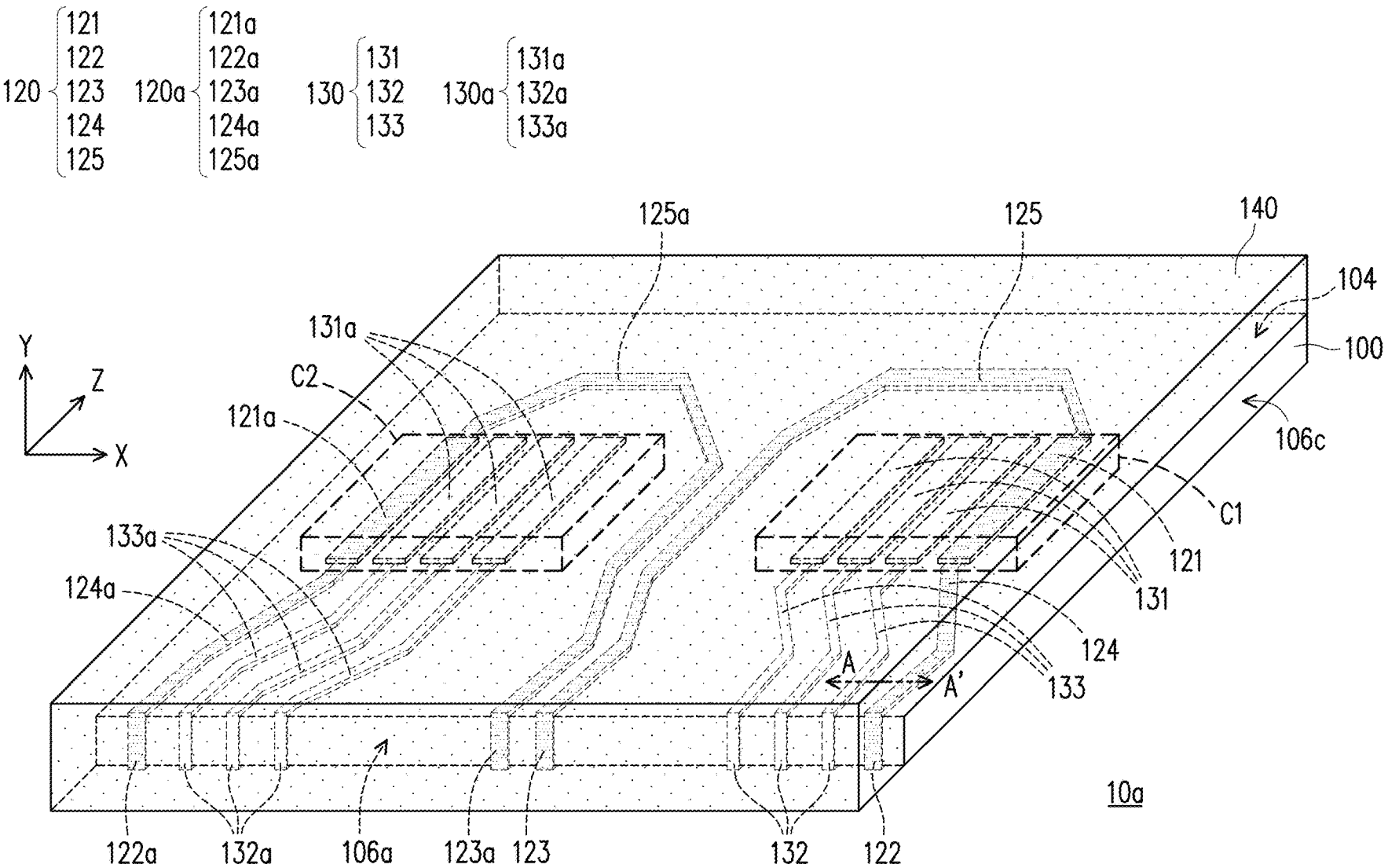
FIG. 2A is a schematic three-dimensional view of a bottom surface of a display panel according to another embodiment of the disclosure.
Figure 2B:
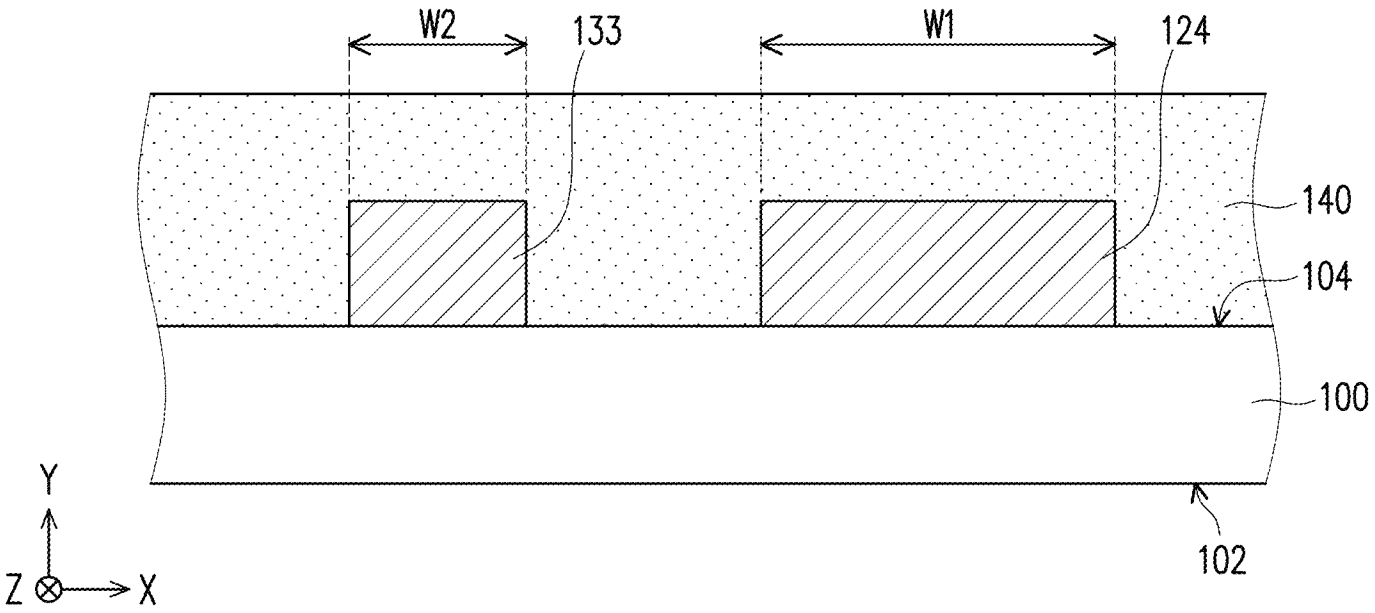
FIG. 2B is a schematic cross-sectional view of the display panel of FIG. 2A along the section line AA'.

FIG. 2A is a schematic three-dimensional view of a bottom surface of a display panel according to another embodiment of the disclosure. FIG. 2B is a schematic cross-sectional view of the display panel of FIG. 2A along the section line AA'. Referring to both FIG. 2B and FIG. 1B, the display panel 10*a* in the embodiment is substantially similar to the display panel 10 of FIG. 1B, so the same and similar elements in the two embodiments are not iterated. The main difference between the display panel 10*a* in the embodiment and the display panel 10 is that the display panel 10*a* in the embodiment further includes an insulating layer 140. Specifically, referring to FIG. 2A, the insulating layer 140 is disposed on the bottom surface 104 of the substrate 100 to cover or protect the circuits disposed on the bottom surface 104, including the power input terminal 121, the power input terminal 121*a*, the first wire 124, the first wire 124*a*, the second wire 125, the second wire 125*a*, the signal input terminal 131, the signal input terminal 131*a*, the third wire 133, the third wire 133*a*, or other electronic elements. In some embodiments, the insulating layer 140 may selectively cover or protect a part of the electronic elements (e.g., the electronic element C1 or the electronic element C2).

In some embodiments, the insulating layer 140 may be disposed on the side surface (e.g., the side surface 106*a*) of the substrate 100 to cover and protect the circuits disposed on the side surface (e.g., the side surface 106*a* or other side surfaces), including the distribution terminal 122, the distribution terminal 122*a*, the distribution terminal 123, the distribution terminal 123*a*, the transmission terminal 132, the transmission terminal 132*a*, or other electronic elements. In the embodiment, the insulating layer 140 may have a single-layer or multi-layer structure, and the material of the insulating layer 140 may include organic materials, inorganic materials, or a combination thereof, but the disclosure is not limited thereto.

Referring to FIG. 2B, in the embodiment, a direction X, a direction Y, and a direction Z are different directions. For example, the direction X, for example, is the substantially extending direction of the section line A-A'; the direction Y, for example, is the normal direction of the substrate 100; the direction Z, for example, may be the substantially extending direction of the first wire 124, the first wire 124*a*, the third wire 133, and the third wire 133*a*; the direction X is substantially perpendicular to the direction Y; the direction Y is substantially perpendicular to the direction Z; and the direction Z is substantially perpendicular to the direction X; but the disclosure is not limited thereto. In the embodiment, the first wire 124 (or the first wire 124*a*) has a width W1, the third wire 133 (or the third wire 133*a*) has a width W2, and the width W1 is greater than or equal to the width W2, but the disclosure is not limited thereto. In the embodiment, the width W1, for example, is the maximum width of the first wire 124 (or the first wire 124*a*) in the direction X, and the width W2, for example, is the maximum width of the third wire 133 (or the third wire 133*a*) in the direction X.

Figure 3:
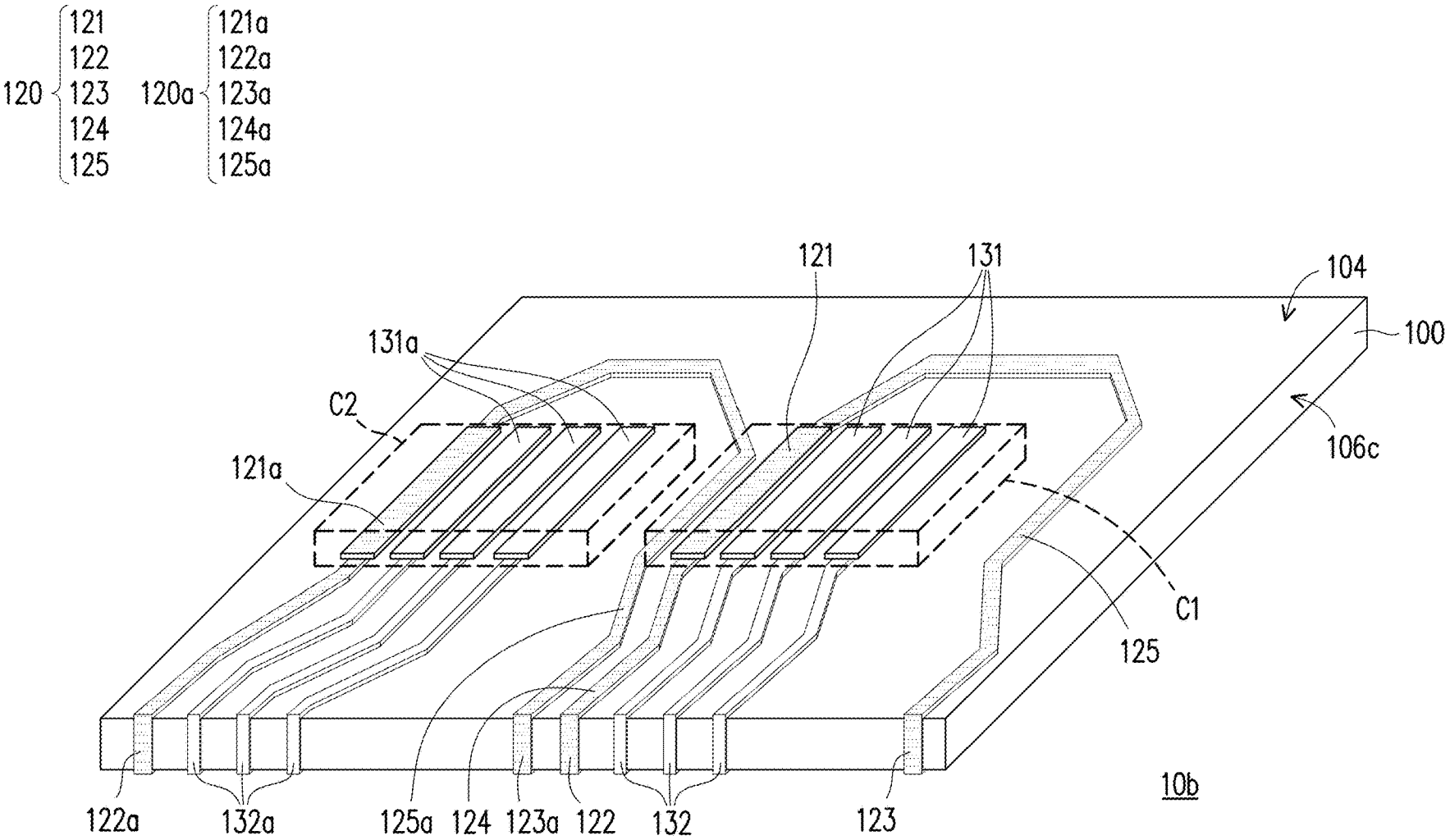
FIG. 3 is a schematic three-dimensional view of a bottom surface of a display panel according to another embodiment of the disclosure.

FIG. 3 is a schematic three-dimensional view of a bottom surface of a display panel according to another embodiment of the disclosure. Referring to both FIG. 1B and FIG. 3, the display panel 10*b* in the embodiment is substantially similar to the display panel 10 of FIG. 1B. Therefore, the same and similar elements in the two embodiments are not iterated. The main difference between the display panel 10*b* in the embodiment and the display panel 10 is that the second wire 125 (or the distribution terminal 123 electrically connected to the second wire 125) of the power supply circuit 120 in the display panel 10*b*, for example, is away from the second wire 125*a* (or the distribution terminal 123*a* electrically connected to the second wire 125*a*) of the power supply circuit 120*a*. In the display panel 10 of FIG. 1B (as shown in FIG. 1B), the second wire 125 (or the distribution terminal 123 electrically connected to the second wire 125) of the power supply circuit 120, for example, is adjacent to the second wire 125*a* (or the distribution terminal 123*a* electrically connected to the second wire 125*a*) of the power supply circuit 120*a*. In addition, the power input terminal 121 of the power supply circuit 120 in the display panel 10*b*, for example, is adjacent to the power supply circuit 120*a* (e.g., the second wire 125*a*), or the power input terminal 121 is away from the side surface 106*c*, for example. the power input terminal 121 of the power supply circuit 120 in the display panel 10*b*, for example, is disposed between the second wire 125*a* and the second wire 125. The power input terminal 121 of the power supply circuit 120 in the display panel 10 (as shown in FIG. 1B), for example, is far away from the power supply circuit 120*a* (e.g., the second wire 125*a*), or the power input terminal 121, for example, is adjacent to the side surface 106*c*.

In some embodiments, the circuit of the second wire 125 may be longer than that of the first wire 124, for example. In some embodiments, the circuit of the second wire 125*a* may be longer than that of the first wire 124*a*, for example. In some embodiments, the second wire 125 includes a first segment, a second segment, a third segment and a fourth segment, and an extension direction of the first segment, an extension direction of the second segment, an extension direction of the third segment and an extension direction of the fourth segment are different. In some embodiments, the fourth segment of the second wire 125 is disposed between an edge of the substrate 100 and the power input terminal 121. In some embodiments, the power input terminal 121 and the power input terminal 121*a* may respectively correspond to the same side of the electrically connected electronic element (e.g., the electronic element C1 or the electronic element C2), and FIG. 3 illustrates that the power input terminal 121 and the power input terminal 121*a* may respectively correspond to the left side of the electrically connected electronic element (e.g., the electronic element C1 or the electronic element C2), but the disclosure is not limited thereto. In other embodiments (not shown), the power input terminal 121 and the power input terminal 121*a* may respectively correspond to the right side of the electrically connected electronic element (e.g., the electronic element C1 or the electronic element C2). In addition, in some embodiments (as shown in FIG. 1B), the power input terminal 121 and the power input terminal 121*a* may respectively correspond to different sides of the electrically connected electronic element (e.g., the electronic element C1 or the electronic element C2). For example, the power input terminal 121 corresponds to the right side of the electrically connected electronic element C1, and the power input terminal 121*a* corresponds to the left side of the electrically connected electronic element C2. Note that the size range of the electronic element C1 or that of the electronic element C2 in all the drawings in the disclosure is only exemplary, but the disclosure is not limited thereto.

Figure 4A:
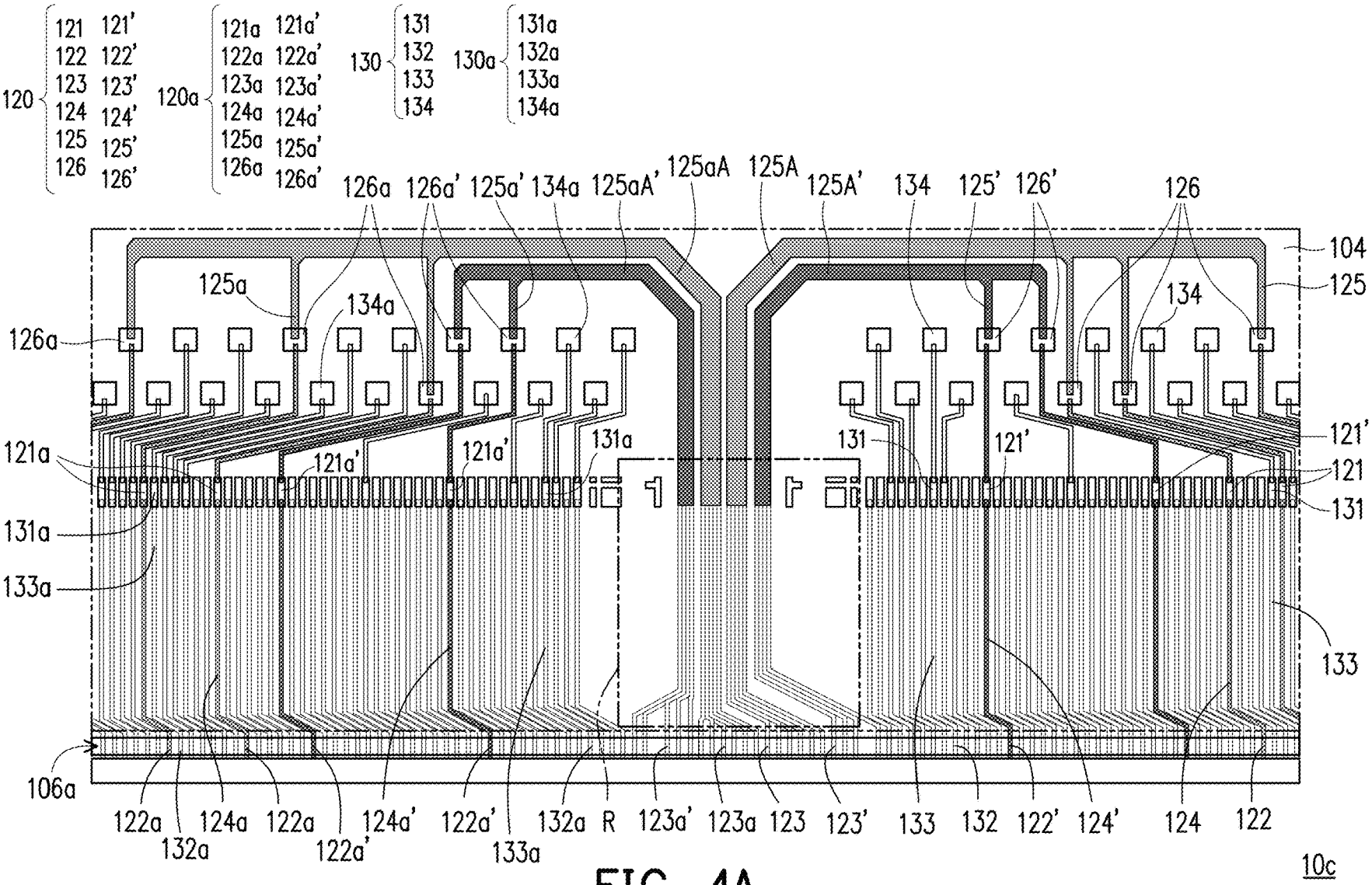
FIG. 4A is a schematic view of a bottom surface of a display panel according to another embodiment of the disclosure.
Figure 4B:
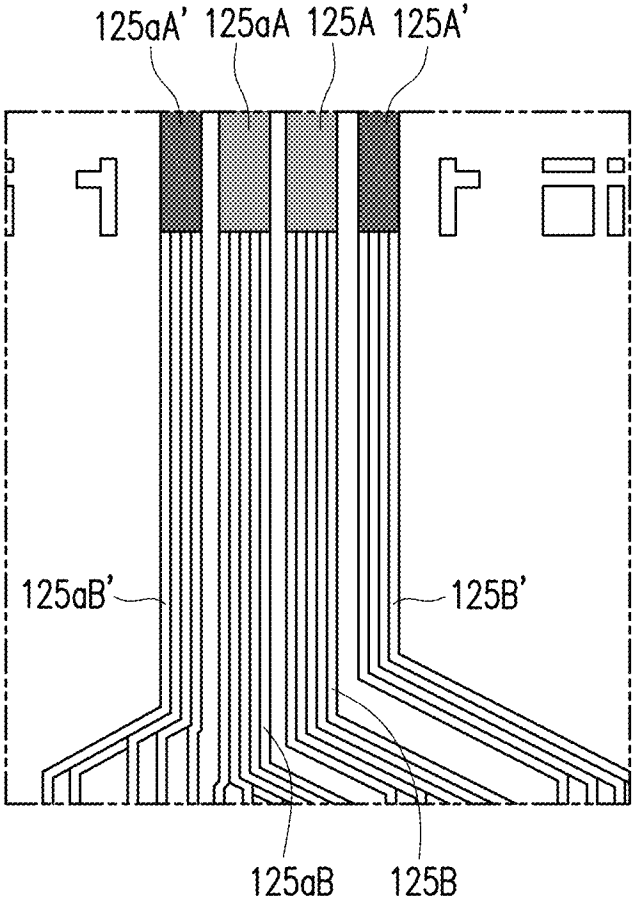
FIG. 4B is an enlarged schematic view of a region R of the display panel of FIG. 4A.

FIG. 4A is a schematic view of a bottom surface of a display panel according to another embodiment of the disclosure. FIG. 4B is an enlarged schematic view of a region R of the display panel of FIG. 4A. Referring to both FIG. 1B and FIG. 4A, the display panel 10*c* in the embodiment is similar to the display panel 10 of FIG. 1B, and the similar elements in the two embodiments are not iterated. In the display panel 10*c*, the power supply circuit 120 has at least one power input terminal 121, at least one power input terminal 121', at least one first wire 124 electrically connected to the corresponding power input terminal 121, at least one first wire 124' electrically connected to the corresponding power input terminal 121', at least one second wire 125 electrically connected to the corresponding power input terminal 121, and at least one second wire 125' electrically connected to the corresponding power input terminal 121'. In some embodiments, the power supply circuit 120 may further have at least one power test pad 126 electrically connected between the corresponding second wire 125 and the corresponding power input terminal 121, respectively. In some embodiments, the power supply circuit 120 may further have at least one power test pad 126' electrically connected between the corresponding second wire 125' and the corresponding power input terminal 121', respectively.

Similarly, the power supply circuit 120*a* may have at least one power input terminal 121*a*, at least one power input terminal 121*a'*, at least one first wire 124*a* electrically connected to the corresponding power input terminal 121*a*, at least one first wire 124*a'* electrically connected to the corresponding power input terminal 121*a'*, at least one second wire 125*a* electrically connected to the corresponding power input terminal 121*a*, and at least one second wire 125*a'* electrically connected to the corresponding power input terminal 121*a'*. In some embodiments, the power supply circuit 120*a* may further have at least one power test pad 126*a* electrically connected between the corresponding second wire 125*a* and the corresponding power input terminal 121*a*, respectively. In some embodiments, the power supply circuit 120*a* may further have at least one power test pad 126*a'* electrically connected between the corresponding second wire 125*a'* and the corresponding power input terminal 121*a'*, respectively.

In some embodiments, the power input terminal 121 and the power input terminal 121' respectively provide or transmit different signals, for example. In some embodiments, the power input terminal 121*a* and the power input terminal 121*a'* respectively provide or transmit different signals, for example. Specifically, referring to FIG. 4A and FIG. 4B, the power input terminal 121 (or power input terminal 121*a*) is adapted to provide high voltages, and the power input terminal 121' (or power input terminal 121*a'*) is adapted to provide low voltages or ground signals, but the disclosure is not limited thereto. In some embodiments, the power input terminal 121 (or the power input terminal 121*a*) may be adapted to provide low voltages or ground signals, and the power input terminal 121' (or power input terminal 121*a'*) may be adapted to provide high voltages, but the disclosure is not limited thereto.

The power supply circuit 120 is illustrated as an example for description below. The power supply circuit 120*a* is similar to the power supply circuit 120. In some embodiments, the first wire 124 may be electrically connected to the distribution terminal 122, the second wire 125 may be electrically connected to the distribution terminal 123, and the first wire 124 may be electrically connected to second wire 125 through the power input terminal 121 and the power test pad 126, but the disclosure is not limited thereto. In some embodiments, the first wire 124' may be electrically connected to the distribution terminal 122', the second wire 125' may be electrically connected to the distribution terminal 123', and the first wire 124' may be electrically connected to the second wire 125' through the power input terminal 121' and the power test pad 126', but the disclosure is not limited thereto.

Referring to FIG. 4A and FIG. 4B, in some embodiments, a plurality of the second wires 125 may be integrated into a main line 125A, the main line 125A may be branched into a plurality of branch portions 125B, and the branch portions 125B respectively may be electrically connected to the distribution terminal 123, for example. In some embodiments, a plurality of the second wires 125' may be integrated into a main line 125A', the main line 125A' may be branched into a plurality of branch portions 125B', and the branch portions 125B' respectively may be electrically connected to the distribution terminal 123', for example. Similarly, in the power supply circuit 120*a*, a plurality of the second wires 125*a* may be integrated into a main line 125*a*A, for example, the main line 125*a*A may be branched into a plurality of branch portions 125*a*B, and the branch portions 125*a*B respectively may be electrically connected to the distribution terminals 123*a*, for example. In some embodiments, a plurality of the second wires 125*a*' may be integrated into a main line 125*a*A', the main line 125*a*A' may be branched into a plurality of branch portions 125*a*B', and the branch portions 125*a*B' respectively may be electrically connected to the distribution terminal 123*a*', for example. In some embodiments, the number of the second wires and the branch portions electrically connected to the different main lines respectively may be changed according to requirements.

Referring to FIG. 4A and FIG. 4B, the power supply circuit 120 is illustrated as an example for description below. The power supply circuit 120*a* may be similar to the power supply circuit 120, for example. In some embodiments, for example, a plurality of the power test pads may be arranged adjacent to one another, or another test pad (e.g., a signal test pad) may be disposed between two power test pads. For example, a plurality of the power test pads 126', for example, may be arranged adjacent to one another, but the disclosure is not limited thereto. In some embodiments, two of the plurality of the power test pads 126, for example, may be arranged adjacent to one another, and there may be at least one signal test pad 134 between two of the plurality of the power test pads 126. In some embodiments, the number of the power test pads 126 may be the same or different from the number of the power test pads 126'. In some embodiments, the number of the signal test pads 134 may be greater than the number of the power test pads 126 and/or the number of the power test pads 126'.

In some embodiments, the signal supply circuit 130 may have at least one signal input terminal 131, at least one third wire 133 electrically connected to one end of the corresponding signal input terminal 131, and at least one signal test pad 134 respectively electrically connected to another end of the corresponding signal input terminal 131. In some embodiments, the signal supply circuit 130*a* may have at least one signal input terminal 131*a*, at least one third wire 133*a* electrically connected to one end of the corresponding signal input terminal 131*a*, and at least one signal test pad 134*a* electrically connected to another end of the signal input terminal 131*a*.

In some embodiments, at least one or more signal input terminals 131 may be disposed between two power input terminals 121 (or the power input terminals 121'). In some embodiments, at least one or more signal input terminals 131*a* may be disposed between two power input terminals 121*a* (or power input terminals 121*a*').

In some embodiments, probes may be adapted to apply preset voltages to the power test pad 126, the power test pad 126', the power test pad 126*a*, the power test pad 126*a*', the signal test pad 134, and/or the signal test pad 134*a*, respectively for light on test or circuit test. For example, whether the circuits among the power supply circuit, the signal supply circuit, the array circuit 110, and the light-emitting elements are conductive or short-circuited may be determined by observing whether the light-emitting elements electrically connected to the power test pads or the signal test pads emit light normally, but the disclosure is not limited thereto. In some embodiments, it is not necessary to dispose a power test pad and/or a signal test pad.

Based on the above, in the display panel and the spliced display device with the display panel in the embodiment of the disclosure, the power input terminal corresponds to at least two distribution terminals, and the at least two distribution terminals are scattered on the side surface of the substrate, so the power is uniformly distributed to different portions of the array circuit (e.g., the first portion and the second portion of the array circuit) through the at least two distribution terminals so that the power (or current) is transmitted to different light-emitting elements more uniformly, and the light-emitting brightness of different light-emitting elements is more uniform.

The above embodiments are merely intended for describing the technical solutions of the present disclosure rather than limiting the present disclosure. Although the present disclosure is described in detail with reference to the foregoing embodiments, those of ordinary skill in the art should understand that they can still make modifications to the technical solutions described in the foregoing embodiments or make equivalent substitutions to some or all technical features thereof, without departing from scope of the technical solutions of the embodiments of the present disclosure.

What is claimed is:

1. An electronic device, comprising:

a substrate with a top surface, a bottom surface, and a side surface located between the top surface and the bottom surface;

an array circuit disposed on the top surface;

a first distribution terminal and a second distribution terminal disposed on the side surface, wherein the first distribution terminal and the second distribution terminal are electrically connected to the array circuit; and a first power input terminal, a first wire and a second wire are disposed on the bottom surface, wherein a first end of the first power input terminal is electrically connected to the first distribution terminal through the first wire, a second end of the first power input terminal is electrically connected to the second distribution terminal through the second wire, the first end of the first power input terminal is opposite to the second end of the first power input terminal, and a first minimum distance between the first end of the first power input terminal and the first distribution terminal is less than a second minimum distance between the second end of the first power input terminal and the first distribution terminal.

2. The electronic device of claim 1, further comprising:

a first signal input terminal and a third wire disposed on the bottom surface, wherein the first wire has a first width, the third wire has a second width, and the first width is different from the second width.

3. The electronic device of claim 2, the first power input terminal, the first wire and the second wire surround the first signal input terminal and the third wire.

4. The electronic device of claim 1, further comprising:

a second power input terminal, a fourth wire and a fifth wire disposed on the bottom surface, a third distribution terminal disposed on the side surface;

wherein the third distribution is electrically connected to a first end of the second power input terminal through the fourth wire, the fifth wire is electrically connected to a second end of the second power input terminal, the first end of the second power input terminal is opposite to the second end of the second power input terminal, and a third minimum distance between the first end of the second power input terminal and the third distribution terminal is less than a fourth minimum distance between the second end of the second power input terminal and the third distribution terminal.

5. The display panel of claim 4, wherein the fifth wire is adjacent to the second wire.

6. The electronic device of claim 3, wherein the first power input terminal is disposed between the fifth wire and the second wire.

7. The electronic device of claim 1, wherein the second wire comprises a first segment, a second segment, a third segment and a fourth segment, and an extension direction of the first segment, an extension direction of the second segment, an extension direction of the third segment and an extension direction of the fourth segment are different.

8. The electronic device of claim 7, wherein the fourth segment is disposed between an edge of the substrate and the first power input terminal.

9. The electronic device of claim 7, wherein the first power input terminal is disposed between an edge of the substrate and the fourth segment.

10. The electronic device of claim 1, wherein the second wire is integrated into a main line, the main line is branched into a plurality of branch portions, and the branch portions are respectively electrically connected to the first distribution terminal.

* * * * *